US009115873B2

(12) United States Patent
Kishimoto

(10) Patent No.: US 9,115,873 B2
(45) Date of Patent: Aug. 25, 2015

(54) LIGHTING DEVICE

(75) Inventor: Katsuhiko Kishimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/233,926

(22) PCT Filed: Jul. 11, 2012

(86) PCT No.: PCT/JP2012/067665
§ 371 (c)(1),
(2), (4) Date: Jan. 21, 2014

(87) PCT Pub. No.: WO2013/021773
PCT Pub. Date: Feb. 14, 2013

(65) Prior Publication Data

US 2014/0185272 A1 Jul. 3, 2014

(30) Foreign Application Priority Data

Aug. 8, 2011 (JP) ..... 2011-172550

(51) Int. Cl.

| | |
|---|---|
| ***F21V 14/08*** | (2006.01) |
| ***F21V 29/02*** | (2006.01) |
| ***F21V 9/16*** | (2006.01) |
| ***F21V 29/70*** | (2015.01) |
| ***F21S 8/10*** | (2006.01) |
| *F21K 99/00* | (2010.01) |
| *F21V 7/06* | (2006.01) |
| *F21Y 101/02* | (2006.01) |
| *F21V 13/08* | (2006.01) |
| *F21V 29/89* | (2015.01) |

(52) U.S. Cl.
CPC ..... *F21V 14/08* (2013.01); *F21S 48/1145* (2013.01); *F21S 48/325* (2013.01); *F21V 9/16* (2013.01); *F21V 29/02* (2013.01); *F21V 29/70* (2015.01); *F21K 9/56* (2013.01); *F21V 7/06* (2013.01); *F21V 13/08* (2013.01); *F21V 29/89* (2015.01); *F21Y 2101/025* (2013.01)

(58) Field of Classification Search
USPC ..... 362/84, 322, 323, 324, 282, 283, 284, 362/269, 271, 259
See application file for complete search history.

(56) References Cited

U.S. PATENT DOCUMENTS

| | | | | |
|---|---|---|---|---|
| 2009/0187234 | A1* | 7/2009 | Meyer et al. | 607/88 |
| 2010/0238412 | A1 | 9/2010 | Kurosaki | |
| 2010/0328625 | A1 | 12/2010 | Miyazaki et al. | |

(Continued)

FOREIGN PATENT DOCUMENTS

| | | | |
|---|---|---|---|
| JP | 2003-295319 | A | 10/2003 |
| JP | 2004-325874 | A | 11/2004 |

(Continued)

OTHER PUBLICATIONS

Official Communication issued in International Patent Application No. PCT/JP2012/067665, mailed on Oct. 2, 2012.

*Primary Examiner* — Laura Tso
(74) *Attorney, Agent, or Firm* — Keating & Bennett, LLP

(57) ABSTRACT

Provided is a lighting device that can suppress decrease in its luminous efficiency and shortening of its life. A lighting device (1) includes a fluorescent member (4) which is irradiated with laser light emitted by a semiconductor laser (2) and emits fluorescent light, a rotation mechanism (6) which rotates the fluorescent member, and a reflecting member (7) which reflects the fluorescent light emitted by the fluorescent member toward the outside.

9 Claims, 7 Drawing Sheets

(56) References Cited

U.S. PATENT DOCUMENTS

| | | | | |
|---|---|---|---|---|
| 2011/0116253 | A1* | 5/2011 | Sugiyama | 362/84 |
| 2011/0149549 | A1* | 6/2011 | Miyake | 362/84 |
| 2011/0211333 | A1* | 9/2011 | Bartlett | 362/84 |
| 2013/0021587 | A1 | 1/2013 | Miyazaki et al. | |

FOREIGN PATENT DOCUMENTS

| | | | |
|---|---|---|---|
| JP | 2004-341105 | A | 12/2004 |
| JP | 2007-200782 | A | 8/2007 |
| JP | 2008-052070 | A | 3/2008 |
| JP | 2009-539219 | A | 11/2009 |
| JP | 2010-217566 | A | 9/2010 |
| JP | 2011-013316 | A | 1/2011 |
| JP | 2011-124002 | A | 6/2011 |
| JP | 2011-221502 | A | 11/2011 |
| JP | 2012-074242 | A | 4/2012 |
| WO | 2011/118536 | A1 | 9/2011 |

* cited by examiner

LIGHTING DEVICE

TECHNICAL FIELD

The present invention relates to a lighting device, and in particular to a lighting device including a fluorescent member to be irradiated with laser light.

BACKGROUND ART

Lighting devices including a fluorescent member which is irradiated with laser light are known (see PTL 1 for example).

PTL 1 discloses a light source device (a lighting device) that includes an ultraviolet LD element (a laser generator) serving as a laser light source, a phosphor (fluorescent member) for converting the laser light emitted by the ultraviolet LD element into visible light, and a visible light reflector mirror for reflecting the visible light emitted by the phosphor. The light source device irradiates the phosphor with laser light serving as excitation light to derive visible light (fluorescent light) from the phosphor and uses the light as illumination light.

CITATION LIST

Patent Literature

PTL 1: Japanese Unexamined Patent Application Publication No. 2003-295319

SUMMARY OF INVENTION

Technical Problem

Since laser light has high light density (high energy density), however, the light source device disclosed in PTL 1 can cause degradation in phosphor particles contained in the phosphor after the phosphor is continuously irradiated with laser light, which results in the problems of insufficient brightness and decrease in the life of the light source device. In addition, when the phosphor is irradiated with laser light, its temperature rises. In general, the luminous efficiency of phosphor decreases as its temperature rises. These properties lead to another problem of decrease in the luminous efficiency of the light source device caused by rise in the phosphor temperature.

The present invention has been made as a solution to these problems and has an object of providing a lighting device that can suppress decrease in its luminous efficiency and shortening of its life.

Solution to Problem

To attain the object, a lighting device according to the present invention includes a fluorescent member which is irradiated with laser light emitted by a laser generator and emits fluorescent light, a rotation mechanism which rotates the fluorescent member, and a reflecting member which reflects toward an outside fluorescent light emitted by the fluorescent member.

The lighting device of the present invention includes the rotation mechanism for rotating the fluorescent member as mentioned above. By rotating the fluorescent member with the rotation mechanism, a particular portion of the fluorescent member is kept from being continuously irradiated with laser light.

In the lighting device, the fluorescent member preferably contains a plurality of kinds or one kind of phosphor particles, and the plurality of kinds or one kind of phosphor particles are present in an entire area of the fluorescent member. With this arrangement, the fluorescent member emits fluorescent light of the same emission spectrum (fluorescent light of the same color) irrespective of in which part the fluorescent member is irradiated with laser light. Thus, even if the fluorescent member is rotated at low speed or temporarily halted, the fluorescent member emits fluorescent light of the same emission spectrum (fluorescent light of the same color). The fluorescent member therefore need not be rotated at high speed or at all times. If, for example, the fluorescent member is formed of three sector regions having a central angle of 120 degrees and respectively containing three kinds of phosphor particles for emitting red light, green light, and blue light, the fluorescent member need to be rotated more than several tens of times per second in order to obtain white light.

In the lighting device, the fluorescent member is preferably formed in a disk shape.

The lighting device preferably further includes a support base which supports the fluorescent member, and the rotation mechanism rotates the fluorescent member by rotating the support base. With such an arrangement, it is not necessary to make the fluorescent member thick in order to secure the strength of the fluorescent member. Also, because there is no need to reserve space on the fluorescent member for attaching the rotation mechanism, an increase in the size of the fluorescent member can be restricted. Additionally, heat generated in the fluorescent member can be transferred to the support base, so heat dissipation of the fluorescent member can be improved and hence rise in the temperature of the fluorescent member can be suppressed.

In the lighting device including the support base, the fluorescent member may be provided on a surface of the support base on the side of the laser generator.

In the lighting device in which the fluorescent member is provided on the surface of the support base on the laser generator side, the support base preferably has a function of blocking fluorescent light. Such an arrangement can prevent fluorescent light emitted by the fluorescent member from passing through the support base and suppress exit of fluorescent light into an area in which it cannot be used as illumination light. The heat dissipation of the fluorescent member may be further improved if the support base is formed from metal, for example. This could further suppress rise in the temperature of the fluorescent member.

Note that when used in the specification and the claims, the language "blocking light" is a concept including absorption and/or reflection of light.

In the lighting device including the support base, the support base may have a function of transmitting laser light, and the fluorescent member may be provided on the surface of the support base on the side opposite to the laser generator.

In the lighting device, the rotation mechanism may be attached to the fluorescent member and rotate the fluorescent member in a direct manner.

In the lighting device, the reflecting member preferably reflects at least part of fluorescent light emitted by the fluorescent member at least once and causes the fluorescent light to exit to the outside. With such an arrangement, at least part of fluorescent light emitted by the fluorescent member can be controlled by the reflecting member, so a particular spot can be efficiently illuminated.

In the lighting device in which the fluorescent member contains a plurality of kinds or one kind of phosphor particles, movement and halt of rotation of the fluorescent member may be alternately repeated by the rotation mechanism.

In the lighting device, the reflecting member preferably includes a reflecting surface formed in a shape having a focal point, and an irradiation area of the fluorescent member to be irradiated with laser light is located at or near the focal point of the reflecting surface. With such an arrangement, light (illumination light) emitted from the lighting device to the outside can be easily collimated or collected, for example.

In the lighting device, the reflecting member preferably includes a concave reflecting surface which reflects fluorescent light, and the irradiation area of the fluorescent member to be irradiated with laser light is located inside the reflecting surface. With such an arrangement, all or almost all of fluorescent light emitted by the fluorescent member can be easily used as illumination light.

In the lighting device, a clearance for allowing passage of fluorescent light reflected off the reflecting member is preferably created between an outer edge of the fluorescent member and the reflecting member. Such an arrangement facilitates exit of fluorescent light reflected off the reflecting member to the outside.

In the lighting device, the fluorescent member may be disposed crosswise through the reflecting member.

The lighting device preferably further includes a fin for moving air around the fluorescent member with rotation of the fluorescent member.

Advantageous Effects of Invention

As outlined above, the present invention includes a rotation mechanism for rotating the fluorescent member. By rotating the fluorescent member with the rotation mechanism, it is possible to prevent only a particular portion of the fluorescent member from being continuously irradiated with laser light. This suppresses degradation in phosphor particles, binder resin, or the like forming the fluorescent member, which in turn prevents the life of the lighting device from being shortened. Avoidance of continuous application of laser light only to a particular portion of the fluorescent member can also suppress rise in the temperature of the irradiation area (a portion of the fluorescent member to be irradiated with laser light), which can suppress decrease in the luminous efficiency of the fluorescent member.

In addition, by providing the reflecting member for reflecting fluorescent light emitted by the fluorescent member toward the outside, fluorescent light emitted by the fluorescent member can be reflected in a certain direction and easily used as illumination light.

DESCRIPTION OF EMBODIMENTS

Embodiments of the present invention will be described below with reference to the accompanying drawings. For facilitating understanding, some cross-sectional views may not be hatched.

First Embodiment

The structure of a lighting device 1 according to a first embodiment of the present invention is described with reference to FIGS. 1 to 5.

Figure 1:
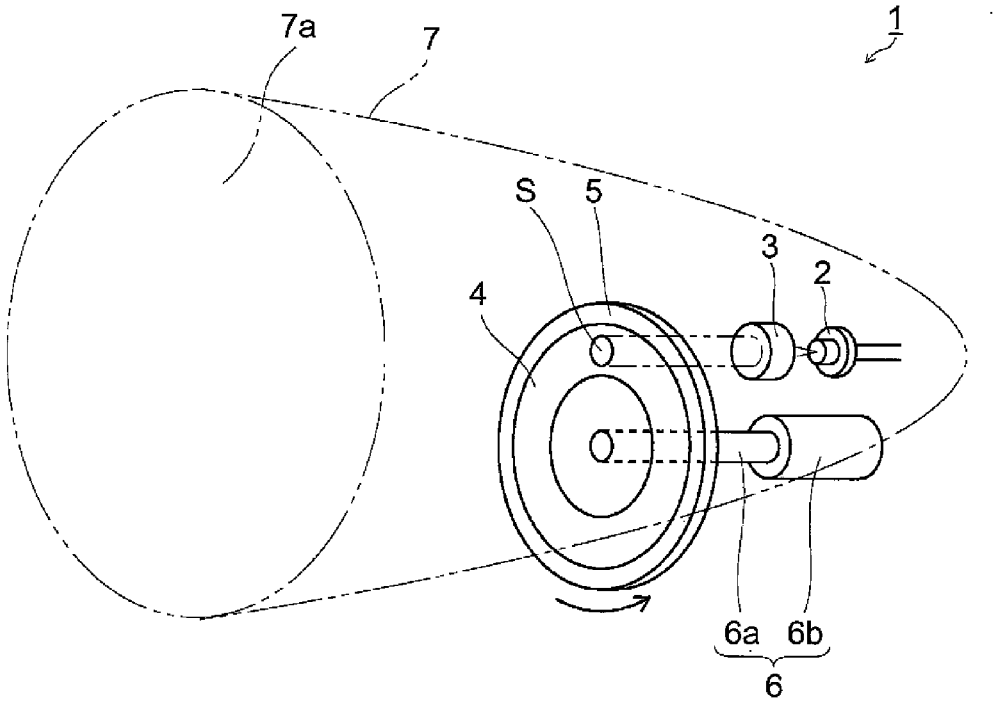
FIG. 1 is a perspective view generally illustrating a structure of a lighting device according to a first embodiment of the invention.

The lighting device 1 according to the first embodiment of the invention is used as a car headlight for illuminating the area ahead of an automobile, for example. As shown in FIG. 1, the lighting device 1 includes a semiconductor laser 2 (a laser generator) that functions as a laser light source (an excitation light source), a light guiding member 3 located in front of the semiconductor laser 2, a fluorescent member 4 which is irradiated with laser light (excitation light), a support base 5 supporting the fluorescent member 4, a rotation mechanism 6 for rotating the fluorescent member 4, and a reflecting member 7 which reflects toward the outside fluorescent light emitted by the fluorescent member 4. As discussed later, the light guiding member 3 and the support base 5 are provided as needed and may be omitted.

The semiconductor laser 2 is constituted by semiconductor laser elements (not shown) and a package containing the semiconductor laser elements. The semiconductor laser 2 is designed to emit laser light having a center wavelength of about 380 nm to about 460 nm, for example.

The light guiding member 3 has the function of guiding laser light emitted by the semiconductor laser 2 to the fluorescent member 4. The light guiding member 3 may be an optical fiber, a lens, a reflector mirror, or a material that guides light by internally reflecting light utilizing a difference in index of refraction relative to the surroundings, or a combination thereof. Note that the light guiding member 3 is provided as needed; it may be omitted if the semiconductor laser 2 is disposed in the vicinity of the fluorescent member 4, for example.

The fluorescent member 4 is formed in a disk shape having a diameter of about 5 mm to 30 mm, for example, and has the function of emitting fluorescent light in response to being irradiated with laser light (excitation light). The fluorescent member 4 contains three kinds of phosphor particles for converting blue-violet laser light into red light, green light, and blue light respectively, for example. The three kinds of phosphor particles are present in the entire area of the fluorescent member 4 substantially uniformly. Alternatively, the fluorescent member 4 may contain only one kind of phosphor particles. In this case, the phosphor particles are also present in the entire area of the fluorescent member 4 substantially uniformly. The fluorescent member 4 may be a hardened mixture of phosphor particles and glass, resin, or the like, or pressed or sintered phosphor particles, for example.

The fluorescent member 4 is supported on the disk-shaped support base 5. The fluorescent member 4 may be fixed to the support base 5 with light-transmissive adhesive (not shown) or formed by applying resin or the like containing phosphor particles to the surface of the support base 5, for example.

In the center of the support base 5, a rotation shaft 6*a* of the rotation mechanism 6 is fixed. The rotation shaft 6*a* is coupled with a motor 6*b* so that driving of the motor 6*b* rotates the rotation shaft 6*a* to cause the support base 5 and fluorescent member 4 to rotate. When the fluorescent member 4 rotates, irradiation area S (a portion of the fluorescent member 4 to be irradiated with laser light) moves within the fluorescent member 4 in circumferential direction. This can keep only a particular portion of the fluorescent member 4 from being continuously irradiated with laser light. It is noted that when the irradiation area S moves in the fluorescent member 4, the position of the irradiation area S relative to the reflecting member 7 does not change.

The rotation speed of the fluorescent member 4 can be set to any speed. For example, the rotation speed of the fluorescent member 4 may be set at several to several tens revolutions/second, or one revolution or less/second. The fluorescent member 4 may also be rotated in a discontinuous manner; rotation and halt may be repeated such that the fluorescent member 4 is rotated a predetermined angle (e.g., 30 or 170 degrees), halted for a certain time period, and then rotated again by the predetermined angle. Since the present invention is aimed at keeping a particular portion of the fluorescent member 4 from being continuously irradiated with laser light, the rotation speed of the fluorescent member 4 can have high flexibility.

The support base 5 may also be formed so as to block light (excitation light and fluorescent light), in which case the support base 5 may be made of metal and have the function of reflecting light. In a case where the support base 5 is formed so as to block light, the fluorescent member 4 is provided on the surface of the support base 5 on the semiconductor laser 2 side (the irradiation side) as depicted in FIG. 2.

Figure 2:
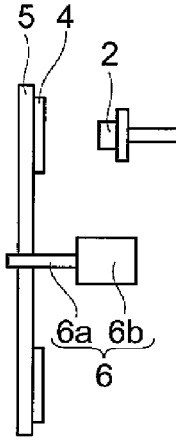
FIG. 2 is a cross-sectional view showing the structure of a fluorescent member and adjacent components in the lighting device in the first embodiment of the invention.
Figure 3:
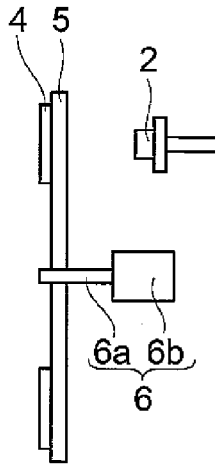
FIG. 3 is a cross-sectional view showing the structure of the fluorescent member and adjacent components in the lighting device in the first embodiment of the invention.

The support base 5 may also be formed so as to transmit light, in which case the fluorescent member 4 may be provided either on the surface of the support base 5 on the side opposite to the semiconductor laser 2 (the surface opposite to the irradiation side) as shown in FIG. 3, or on the surface of the support base 5 on the semiconductor laser 2 side as shown in FIG. 2. For the structure of FIG. 3, not all portion of the support base 5 needs transmit light; at least a portion irradiated with laser light has to be formed so as to transmit light.

Figure 4:
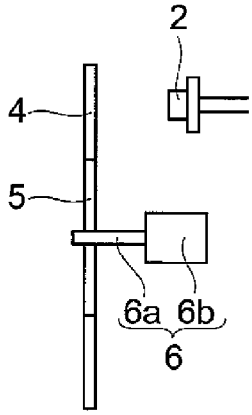
FIG. 4 is a cross-sectional view showing the structure of the fluorescent member and adjacent components in the lighting device in the first embodiment of the invention.
Figure 5:
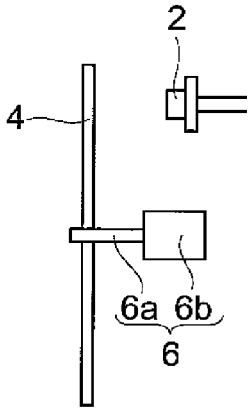
FIG. 5 is a cross-sectional view showing the structure of the fluorescent member and adjacent components in the lighting device in the first embodiment of the invention.

The fluorescent member 4 may also be formed on the periphery of the support base 5 as depicted in FIG. 4. Alternatively, the rotation shaft 6*a* of the rotation mechanism 6 may be fixed at the center of the fluorescent member 4 without the support base 5 as shown in FIG. 5. That is, the rotation mechanism 6 may be attached to the fluorescent member 4 and rotate the fluorescent member 4 directly.

As shown in FIG. 1, the reflecting member 7 has the function of reflecting fluorescent light emitted by the fluorescent member 4 toward the outside. A reflecting surface 7*a* of the reflecting member 7 is formed in a concave shape, being formed so as to include a part of a paraboloid, for example. The reflecting member 7 may be disposed such that the focal point of the reflecting surface 7*a* substantially coincides with the irradiation area S of the fluorescent member 4. The irradiation area S of the fluorescent member 4 may also be located inside the reflecting surface 7*a*.

This embodiment includes the rotation mechanism 6 for rotating the fluorescent member 4 as described above and rotation of the fluorescent member 4 causes the irradiation area S to move in the fluorescent member 4, thereby keeping only a particular portion of the fluorescent member 4 from being continuously irradiated with laser light. This suppresses degradation in phosphor particles, binder resin, or the like forming the fluorescent member 4, which in turn prevents the life of the lighting device 1 from being shortened. Avoidance of continuous application of laser light only to a particular portion of the fluorescent member 4 can also suppress rise in the temperature of the irradiation area S, which can suppress decrease in the luminous efficiency of the fluorescent member 4.

By providing the reflecting member 7 to reflect fluorescent light emitted by the fluorescent member 4 toward the outside, fluorescent light emitted by the fluorescent member 4 can be reflected in a certain direction and easily used as illumination light.

As mentioned above, the fluorescent member 4 contains multiple kinds (or one kind) of phosphor particles and the multiple kinds (or one kind) of phosphor particles are present in the entire area of the fluorescent member 4. Consequently, the fluorescent member 4 emits fluorescent light of the same emission spectrum (fluorescent light of the same color) irrespective of in which part the fluorescent member 4 is irradiated with laser light. That is, red light, green light, and blue light are emitted by the fluorescent member 4 to result in white light irrespective of which part of the fluorescent member 4 is irradiated with laser light. Thus, even if the fluorescent member 4 is rotated at low speed or temporarily halted, white light (red light, green light, and blue light) will be emitted by the fluorescent member 4. The fluorescent member 4 therefore need not be rotated at high speed or at all times; its rotation speed can have high flexibility. If, for example, the fluorescent member is formed of three sector regions having a central angle of 120 degrees and respectively containing three kinds of phosphor particles for emitting red light, green light, and blue light, the fluorescent member need to be rotated more than several tens of times per second in order to obtain white light.

Due to the provision of the support base 5 supporting the fluorescent member 4 as mentioned above, it is not necessary to make the fluorescent member 4 thick in order to secure the strength of the fluorescent member 4. Also, because there is no need to reserve space on the fluorescent member 4 for attaching the rotation mechanism 6, an increase in the size of the fluorescent member 4 can be restricted. Additionally, heat generated in the fluorescent member 4 can be radiated into the support base 5, so heat dissipation of the fluorescent member 4 can be improved and thereby rise in the temperature of the fluorescent member 4 can be suppressed.

The heat dissipation of the fluorescent member 4 could be further improved if the support base 5 is formed from metal, for example, as mentioned above. This could further suppress rise in the temperature of the fluorescent member 4. In this case, efficiency of light utilization could be improved if the support base 5 has the function of reflecting light.

By positioning the irradiation area S of the fluorescent member 4 so as to substantially coincide with the focal point of the reflecting surface 7*a* as mentioned above, light (illumination light) emitted from the lighting device 1 to the outside can be easily collimated.

If the irradiation area S of the fluorescent member 4 is located inside the reflecting surface 7*a* as mentioned above, all or almost all of fluorescent light emitted by the fluorescent member 4 can be easily used as illumination light.

Second Embodiment

In a second embodiment of the invention described below, the support base 5 is formed so as to block light (the support base 5 has no light transmissivity).

Figure 6:
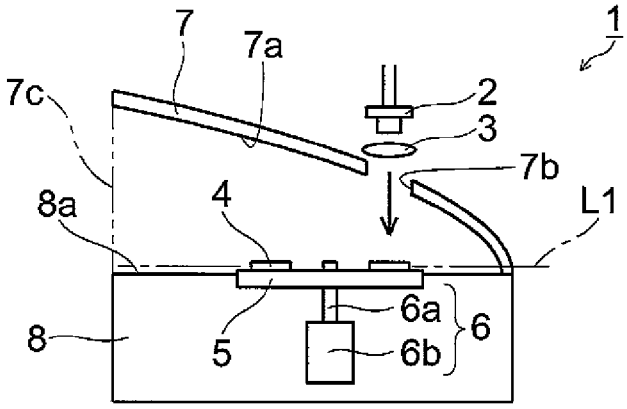
FIG. 6 is a cross-sectional view showing a structure of the lighting device according to a second embodiment of the invention.

The lighting device 1 according to the second embodiment of the invention includes a semiconductor laser 2, a light guiding member 3 which comprises a lens for example, a fluorescent member 4, a support base 5, a rotation mechanism 6, a reflecting member 7, and a housing member 8 in which the rotation mechanism 6 is housed, as illustrated in FIG. 6.

The reflecting surface 7*a* of the reflecting member 7 is formed so as to include a part of a paraboloid for example, formed in a shape like a paraboloid divided in a plane parallel with the axis connecting the vertex and the focal point (the rotation axis L1 of the paraboloid). The reflecting member 7 has a through hole 7*b* formed therein at a given position for allowing laser light to pass through. The semiconductor laser 2 is located outside the through hole 7*b*.

The housing member 8 is formed from metal in a box-like shape. The housing member 8 is fixed to the reflecting member 7 and an upper surface 8*a* of the housing member 8 is formed as a reflecting surface that reflects light. Due to presence of the housing member 8, any laser light emitted by the semiconductor laser 2 that has passed through the fluorescent member 4 and the support base 5 can be confined in the housing member 8, so that it does not become stray light.

The fluorescent member 4 is positioned substantially parallel with the rotation axis L1 of the paraboloid and also substantially perpendicularly to an open side 7*c* of the reflecting member 7. The fluorescent member 4 is also located so as to face the reflecting surface 7*a* of the reflecting member 7. The reflecting member 7 is disposed such that the focal point of the reflecting surface 7*a* substantially coincides with the irradiation area S of the fluorescent member 4. The fluorescent member 4 is formed on the surface of the support base 5 on the semiconductor laser 2 side (the irradiation side surface).

The support base 5 has the function of blocking light (laser light and fluorescent light) and is formed from metal, for example.

In the lighting device 1, light emitted by the fluorescent member 4 to the irradiation side (the semiconductor laser 2 side) is used as illumination light. Some of light emitted by the fluorescent member 4 exits to the outside without being reflected off the reflecting member 7 and the remaining light is reflected off the reflecting member 7 and exits to the outside.

Other structures and effects of the second embodiment are similar to the first embodiment.

Third Embodiment

According to a third embodiment of the present invention described below, unlike the second embodiment, the fluorescent member 4 is positioned substantially parallel with the open side 7*c* of the reflecting member 7.

Figure 7:
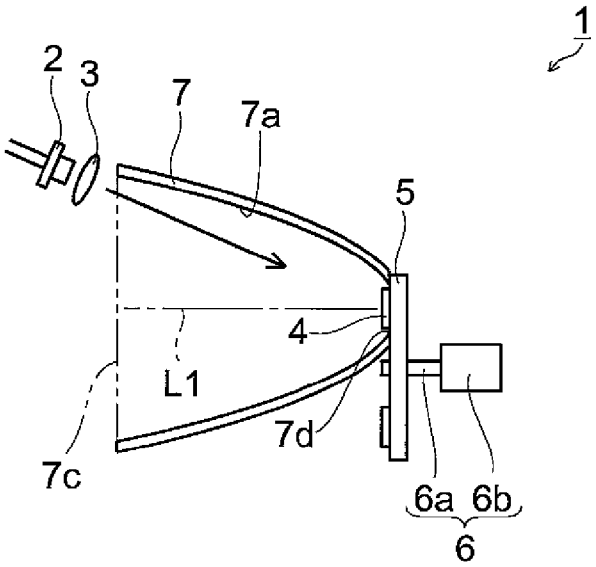
FIG. 7 is a cross-sectional view showing a structure of the lighting device according to a third embodiment of the invention.

The lighting device 1 according to the third embodiment of the invention includes a semiconductor laser 2, a light guiding member 3, a fluorescent member 4, a support base 5, a rotation mechanism 6, and a reflecting member 7 as depicted in FIG. 7.

Near the vertex of the reflecting member 7, an opening 7*d* in which to dispose the fluorescent member 4 is formed. The support base 5 and the rotation mechanism 6 are located outside the reflecting member 7.

The fluorescent member 4 is positioned substantially perpendicularly to the rotation axis L1 of the paraboloid (reflecting surface 7*a*) and also substantially parallel with the open side 7*c* of the reflecting member 7. The fluorescent member 4 is also located so as to face the open side 7*c* side of the reflecting member 7. The semiconductor laser 2 is located outside the open side 7*c* of the reflecting member 7.

As in the second embodiment, the lighting device 1 in this embodiment uses light emitted by the fluorescent member 4 to the irradiation side (the semiconductor laser 2 side) as illumination light. Some of light emitted by the fluorescent member 4 exits to the outside without being reflected off the reflecting member 7 and the remaining light is reflected off the reflecting member 7 and exits to the outside.

Other structures and effects of the third embodiment are similar to the second embodiment.

Fourth Embodiment

According to a fourth embodiment of the invention described below, unlike the second and third embodiments, almost all of the fluorescent light emitted by the fluorescent member 4 is reflected off the reflecting member 7 and exits to the outside.

Figure 8:
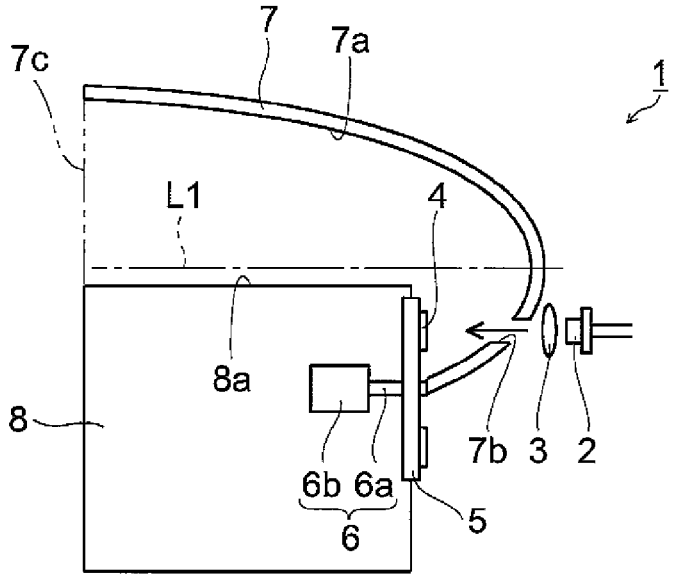
FIG. 8 is a cross-sectional view showing a structure of the lighting device according to a fourth embodiment of the invention.

The lighting device 1 in the fourth embodiment of the invention includes a semiconductor laser 2, a light guiding member 3, a fluorescent member 4, a support base 5, a rotation mechanism 6, a reflecting member 7, and a housing member 8 as depicted in FIG. 8.

The reflecting member 7 has a through hole 7*b* formed therein at a given position for allowing laser light to pass through. A part of the housing member 8 is located inside the reflecting surface 7*a* of the reflecting member 7.

The fluorescent member 4 is positioned substantially perpendicularly to the rotation axis L1 of the paraboloid (reflecting surface 7*a*) and also so as to face the vertex side of the reflecting surface 7*a* of the reflecting member 7 (the opposite side to the open side 7*c*).

In the lighting device 1 according to this embodiment, light emitted by the fluorescent member 4 to the irradiation side (semiconductor laser 2 side) is used as illumination light. Almost all of fluorescent light emitted by the fluorescent member 4 is reflected off the reflecting member 7 and exits to the outside. In other words, all of illumination light emitted by the lighting device 1 has been reflected off the reflecting member 7 at least once and exits to the outside.

Other structures of the fourth embodiment are similar to the third embodiment.

According to this embodiment, the reflecting member 7 reflects almost all of the fluorescent light emitted by the fluorescent member 4 at least once and causes the fluorescent light to exit to the outside as mentioned above. Thus, almost all of fluorescent light emitted by the fluorescent member 4 can be controlled by the reflecting member 7, so a particular spot can be efficiently illuminated.

Other effects of the fourth embodiment are similar to the first to third embodiments.

Fifth Embodiment

According to a fifth embodiment of the invention described below, unlike the fourth embodiment, the housing member 8 is not provided.

Figure 9:
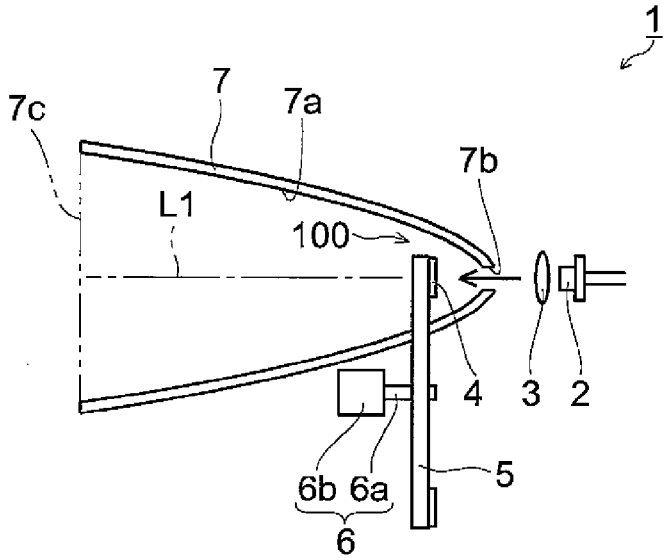
FIG. 9 is a cross-sectional view showing a structure of the lighting device according to a fifth embodiment of the invention.

A lighting device 1 in the fifth embodiment of the invention includes a semiconductor laser 2, a light guiding member 3, a fluorescent member 4, a support base 5, a rotation mechanism 6, and a reflecting member 7 as depicted in FIG. 9.

The reflecting member 7 has a through hole 7*b* formed therein near the vertex for allowing laser light to pass through.

The fluorescent member 4 is positioned substantially perpendicularly to the rotation axis L1 of the paraboloid (reflecting surface 7*a*) and also substantially parallel to the open side 7*c* of the reflecting member 7. The fluorescent member 4 is also disposed facing the vertex side of the reflecting surface 7*a* of the reflecting member 7 (the opposite side to the open side 7*c*).

Part of the fluorescent member 4 and part of the support base 5 are located inside the reflecting surface 7*a*. The rotation mechanism 6 is disposed outside the reflecting member 7.

A clearance 100 for allowing passage of fluorescent light reflected off the reflecting member 7 is created between the outer edges of the fluorescent member 4 and the support base 5, and the reflecting surface 7*a* of the reflecting member 7.

Figure 10:
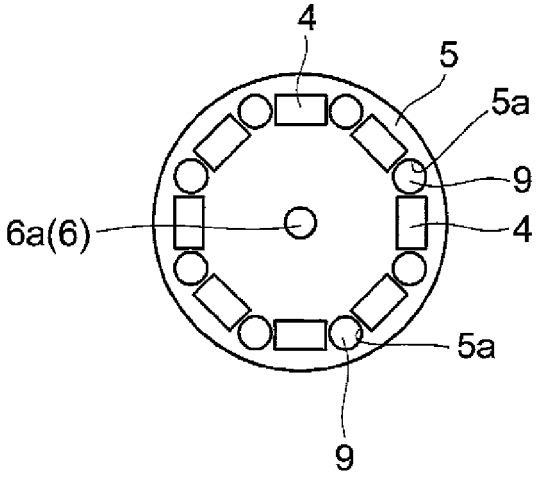
FIG. 10 is a front view showing a structure of the fluorescent member and a support base of the lighting device according to the fifth embodiment of the invention.

In the fifth embodiment, light that has passed through the clearance 100 between the reflecting surface 7*a* of the reflecting member 7 and the support base 5 is used as illumination light. As sufficient fluorescent light cannot be drawn out of the lighting device 1 if the clearance 100 is not sufficiently large, the fluorescent member 4 and support base 5 may be structured as shown in FIG. 10. Specifically, multiple openings 5*a* for letting through fluorescent light are formed in the support base 5, and filters 9 that block excitation light and transmit fluorescent light are provided in the openings 5*a*. This can suppress decrease of efficiency in drawing fluorescent light emitted by the fluorescent member 4 to the outside. The fluorescent member 4 may be formed as multiple parts as shown in FIG. 10 or formed in a disk shape as described in the first embodiment. The shape of the opening 5*a* and the fluorescent member 4 is not limited to a circular or rectangular shape but may be any shape. In a case where the center wavelength of excitation light is about 405 nm, for example, ITY-425 manufactured by Isuzu Glass Co., Ltd., which absorbs light of wavelengths equal to or below about 425 nm and transmits light of wavelengths greater than about 425 nm, may be used as the filter 9, for instance.

In the lighting device 1 in this embodiment, light emitted by the fluorescent member 4 to the irradiation side (the semiconductor laser 2 side) is used as illumination light as in the fourth embodiment. Almost all of the fluorescent light emitted by the fluorescent member 4 is reflected off the reflecting member 7 and exits to the outside.

Other structures of the fifth embodiment are similar to the fourth embodiment.

According to this embodiment, the clearance 100 for allowing passage of fluorescent light reflected off the reflecting member 7 is created between the outer edges of the fluorescent member 4 and the support base 5, and the reflecting surface 7*a* of the reflecting member 7 as mentioned above. This facilitates exit of fluorescent light reflected off the reflecting member 7 to the outside.

Other effects of the fifth embodiment are similar to the fourth embodiment.

Sixth Embodiment

In a sixth embodiment described below, the support base 5 is formed so as to transmit light (the support base 5 has light transmissivity) unlike the second to fifth embodiments.

Figure 11:
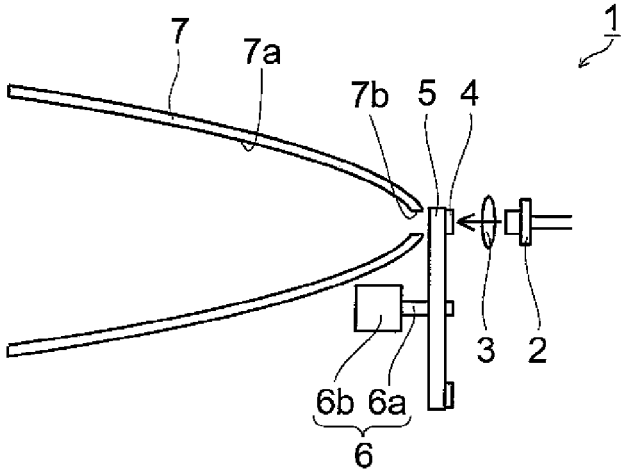
FIG. 11 is a cross-sectional view showing a structure of the lighting device according to a sixth embodiment of the invention.

A lighting device 1 in the sixth embodiment of the invention includes a semiconductor laser 2, a light guiding member 3, a fluorescent member 4, a support base 5, a rotation mechanism 6, and a reflecting member 7 as depicted in FIG. 11.

The reflecting member 7 has a through hole 7*b* formed therein near the vertex for allowing fluorescent light to pass through.

The fluorescent member 4 and the support base 5 are disposed outside the reflecting member 7. The support base 5 is formed from plate glass or the like so that it transmits light (excitation light and fluorescent light).

In the lighting device 1 in this embodiment, light emitted by the fluorescent member 4 to the side opposite to the irradiation side (semiconductor laser 2 side) is used as illumination light. Specifically, light emitted by the fluorescent member 4 to the irradiation side is not used as illumination light, while light emitted by the fluorescent member 4 to the side opposite to the irradiation side (the support base 5 side) passes through the support base 5 to be used as illumination light. Since only excitation light that has passed through the fluorescent member 4 exits to the outside, excitation light, which is laser light, can exit to the outside being sufficiently diffused in the fluorescent member 4 and with large emission points. This provides improved safety for the eyes and accordingly realizes a lighting device that is safe to use without using a component for blocking excitation light (such as optical film), which is used in the seventh embodiment described later.

Other structures and effects of the sixth embodiment are similar to the fifth embodiment.

Seventh Embodiment

Figure 12:
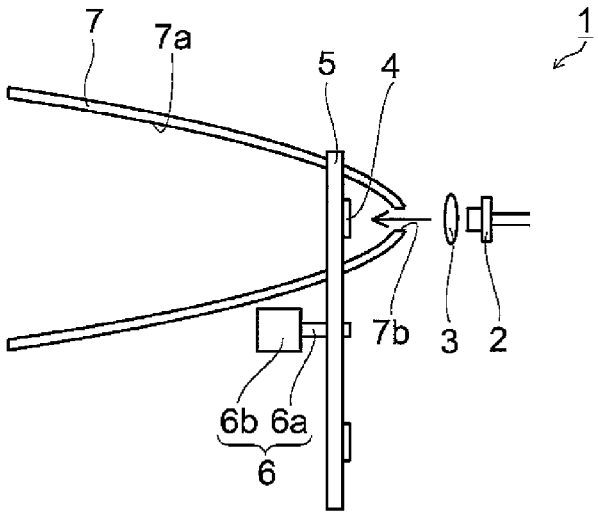
FIG. 12 is a cross-sectional view showing a structure of the lighting device according to a seventh embodiment of the invention.

In the lighting device 1 according to a seventh embodiment of the present invention, part of the fluorescent member 4 and part of the support base 5 are disposed inside the reflecting surface 7*a* as depicted in FIG. 12 unlike the sixth embodiment. The support base 5 is disposed crosswise through the reflecting member 7. Accordingly, no clearance 100 is created between the reflecting surface 7*a* of the reflecting member 7 and the support base 5, unlike the fifth embodiment.

Preferably, an optical film (not shown) that blocks excitation light and transmits fluorescent light is formed on the surface of the support base 5. With such an arrangement, fluorescent light emitted by the fluorescent member 4 passes through the support base 5 and exits to the outside. Meanwhile, excitation light reflected off the surface of the fluorescent member 4 is repeatedly reflected between the reflecting surface 7*a* and the optical film to be eventually incident on the fluorescent member 4 and converted to fluorescent light. The fluorescent light generated by the conversion then exits to the outside through the support base 5. Thus, excitation light can be converted to fluorescent light at high efficiency, which can improve the efficiency of light utilization.

Formation of optical film that blocks excitation light and transmits fluorescent light on the surface of the support base 5 can inhibit the exit of excitation light to the outside. As a result, safety for the eyes can be further improved.

Other structures and effects of the seventh embodiment are similar to the sixth embodiment.

The embodiments disclosed herein should be construed as illustrative and not limitative in all respects. The scope of the present invention is defined not by the description of the embodiments presented above but by the appended claims and includes all modifications that fall within the scope and meaning equivalent to the claims.

For example, while the lighting device of the present invention is described as being used for a car headlight in the embodiments discussed above, the invention is not limited thereto. The inventive lighting device is also applicable as a front light for an airplane, ship, robot, motorcycle, bicycle, or other kinds of mobile object.

While the lighting device of the present invention is described as being applied to a headlight in the embodiments discussed above, the invention is not limited thereto. The inventive lighting device is also applicable as a downlight, spotlight, or other kinds of lighting device.

While excitation light is converted to visible light in the embodiments described above, the present invention is not limited thereto; excitation light may be converted to light other than visible light. For instance, with conversion of excitation light to infrared light, the lighting device can be applied to a night lighting device for a security CCD camera.

While the excitation light source (semiconductor laser) and the fluorescent member are adapted to emit white light in the embodiments described above, the present invention is not limited thereto. The excitation light source and fluorescent member may be adapted to emit light other than white light.

While a semiconductor laser is used as a laser generator for emitting laser light in the embodiments described above, the present invention is not limited thereto; a laser generator other than a semiconductor laser may be employed.

The numerical values shown in the description of embodiments are illustrative examples and not limitations.

While the reflecting surface of the reflecting member is formed by a portion of a paraboloid in the embodiments described above, the present invention is not limited thereto; the reflecting surface may be formed by a portion of an ellipsoid, for example. In this case, by positioning the irradiation area of the fluorescent member at the focal point of the reflecting surface, light emitted by the lighting device can be easily collected. It is also possible to form the reflecting surface with a multi-reflector composed of many curved surfaces (e.g., paraboloids) or a free-form surface reflector on which many minute planes are formed continuously.

While the fluorescent member and the support base are formed in a disk-shape in the above embodiments, the present invention is not limited thereto; they may be formed in a shape other than a disk shape. For example, the fluorescent member and the support base may have a square or polygonal shape when seen from the front.

Figure 13:
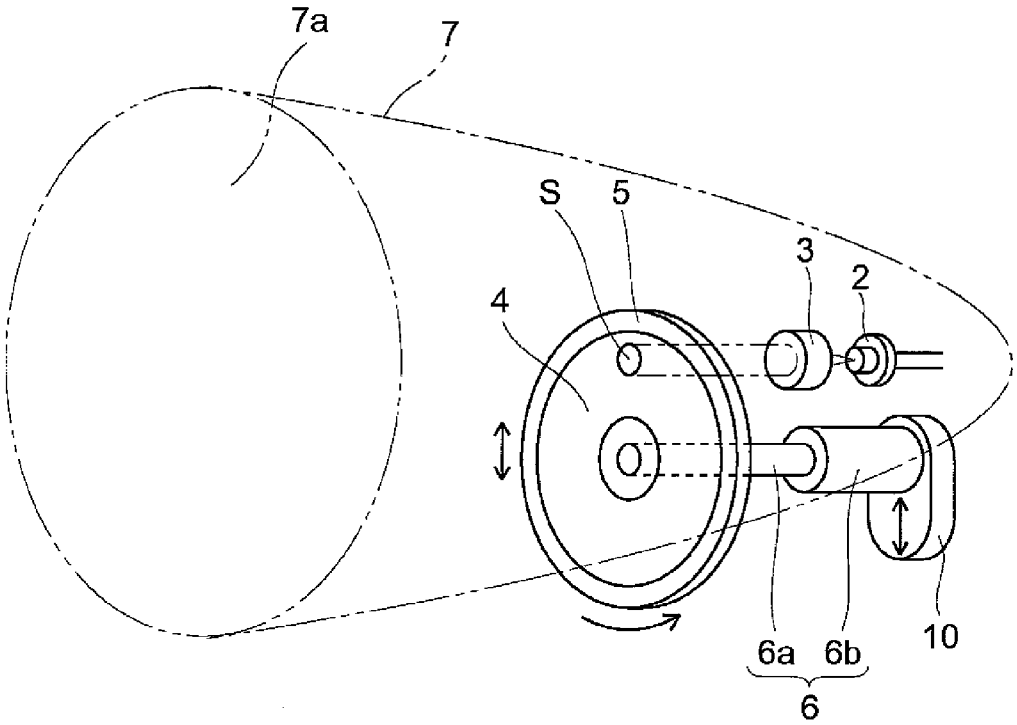
FIG. 13 is a perspective view generally showing a structure of a first variation of the inventive lighting device.

While the irradiation area is moved within the fluorescent member by rotating the fluorescent member in the embodiments described above, the present invention is not limited thereto. For example, a movement mechanism 10 for moving the rotation mechanism 6 in an in-plane direction (e.g., radial direction) of the fluorescent member 4 may be further provided so that irradiation area S can be moved both in the circumferential and radial directions of the fluorescent member 4 as a first variation of the inventive lighting device shown in FIG. 13.

While the support base has no light transmissivity in the fifth embodiment described above, the support base may be light transmissive in the structure of the fifth embodiment.

Further, a filter that transmits fluorescent light and blocks excitation light (laser light) may be provided at the open side of the reflecting member. Such an arrangement can prevent the exit of laser light to the outside and easily improve safety for the eyes.

Figure 14:
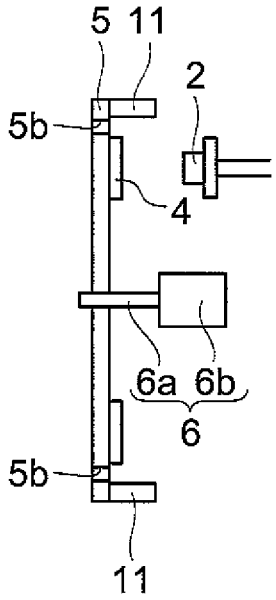
FIG. 14 is a cross-sectional view showing a structure of the fluorescent member and adjacent components in a second variation of the inventive lighting device.

In addition, multiple fins 11 may be provided integrally with the support base 5 for circulating the air around the fluorescent member 4 with rotation of the fluorescent member 4 as in a second variation of the inventive lighting device shown in FIG. 14. Multiple air holes **5*b* may also be formed in the support base 5 between the fins 11 and the fluorescent member 4, for example. With such an arrangement, when the fluorescent member 4 and support base 5 rotate, air circulates through the air holes 5*b*. This further suppresses rise in the temperature of the irradiation area effectively. The fins 11 may be provided around the fluorescent member 4, and they may also be attached to the fluorescent member 4 and/or the rotation shaft 6*a* of the rotation mechanism 6**.

While three kinds of phosphor particles are described as being present in the entire area of the fluorescent member substantially uniformly in the embodiments discussed above, the present invention is not limited thereto. For example, the fluorescent member is formed of three sector regions having a central angle of 120 degrees, which may respectively contain the three kinds of phosphor particles. In this case, however, the fluorescent member needs to be rotated more than several tens of times per second in order to obtain white light.

REFERENCE SIGNS LIST

1 lighting device
2 semiconductor laser (laser generator)
3 light guiding member
4 fluorescent member
5 support base
6 rotation mechanism
7 reflecting member
**7*a*** reflecting surface
11 fin
100 clearance
S irradiation area

The invention claimed is:

1. A lighting device comprising:

a fluorescent member which is irradiated with laser light emitted by a laser generator and which emits fluorescent light;

a rotation mechanism which rotates the fluorescent member;

a reflecting member which reflects the fluorescent light emitted by the fluorescent member; and a support base which supports the fluorescent member; wherein the fluorescent member is formed in a disk shape, the fluorescent member contains a plurality of kinds or one kind of phosphor particles, the plurality of kinds or the one kind of phosphor particles are present in an entire area of the fluorescent member, and the support base is configured to transmit the laser light.

2. The lighting device according to claim 1, wherein the rotation mechanism rotates the fluorescent member by rotating the support base.

3. The lighting device according to claim 2, wherein the fluorescent member is provided on a surface of the support base on a side of the laser generator.

4. The lighting device according to claim 2, wherein the fluorescent member is provided on the surface of the support base on the side opposite to the laser generator.

5. The lighting device according to claim 1, wherein the reflecting member reflects at least a portion of the fluorescent light emitted by the fluorescent member at least once.

6. The lighting device according to claim 1, wherein the reflecting member includes a concave reflecting surface which is configured to reflect the fluorescent light, and an irradiation area of the fluorescent member which is configured to be irradiated with the laser light is located inside the reflecting surface.

7. The lighting device according to claim 1, wherein the fluorescent member is disposed crosswise through the reflecting member.

8. A lighting device comprising:

a fluorescent member which is irradiated with laser light emitted by a laser generator and which emits fluorescent light;

a rotation mechanism which rotates the fluorescent member; and a reflecting member which reflects the fluorescent light emitted by the fluorescent member; wherein the fluorescent member is formed in a disk shape, the fluorescent member contains a plurality of kinds or one kind of phosphor particles, the plurality of kinds or the one kind of phosphor particles are present in an entire area of the fluorescent member, the reflecting member includes a reflecting surface formed in a shape having a focal point, and an irradiation area of the fluorescent member to be irradiated with the laser light is located at or near the focal point of the reflecting surface.

9. A lighting device comprising:

a fluorescent member which is irradiated with laser light emitted by a laser generator and which emits fluorescent light;

a rotation mechanism which rotates the fluorescent member; and a reflecting member which reflects the fluorescent light emitted by the fluorescent member; wherein the fluorescent member is formed in a disk shape, the fluorescent member contains a plurality of kinds or one kind of phosphor particles, the plurality of kinds or the one kind of phosphor particles are present in an entire area of the fluorescent member, and a clearance which allows passage of fluorescent light reflected off the reflecting member is defined between an outer edge of the fluorescent member and the reflecting member.

* * * * *